US006375069B1

(12) United States Patent
Smith

(10) Patent No.: US 6,375,069 B1
(45) Date of Patent: Apr. 23, 2002

(54) TAMPER EVIDENT CONTAINER

(75) Inventor: Ernest L. Smith, Kansas City, MO (US)

(73) Assignee: Sealright Co., Inc., Desoto, KS (US)

( * ) Notice: Subject to any disclaimer, the term of this patent is extended or adjusted under 35 U.S.C. 154(b) by 0 days.

(21) Appl. No.: 09/864,517

(22) Filed: May 24, 2001

(51) Int. Cl.[7] ..... B65D 5/54; B65D 17/40
(52) U.S. Cl. ..... 229/211; 229/235
(58) Field of Search ..... 229/211, 223, 229/235; 220/266, 276

(56) References Cited

U.S. PATENT DOCUMENTS 2,898,025 A * 8/1959 Walker ..... 229/211
3,580,481 A * 5/1971 Koboldt ..... 229/211
3,833,113 A * 9/1974 Osler ..... 229/235
3,958,747 A * 5/1976 Chipp et al. ..... 229/211
4,207,989 A * 6/1980 Ingemann ..... 220/266
4,301,939 A * 11/1981 Pupp ..... 229/211
4,406,462 A * 9/1983 Bogren ..... 229/211
4,529,100 A * 7/1985 Ingemann ..... 220/276
5,052,574 A * 10/1991 McKinnon et al. ..... 220/276
5,582,345 A * 12/1996 Lankhuijzen ..... 229/235
5,758,793 A * 6/1998 Forsyth et al. ..... 220/276

* cited by examiner

*Primary Examiner*—Gary E. Elkins
(74) *Attorney, Agent, or Firm*—Shook, Hardy & Bacon LLP

(57) ABSTRACT

A tamper resistant package for foods and other materials includes a container and a plug closure having a side wall and a flange spaced outwardly from the side wall. A detachable tear strip on the upper edge of the container is initially heat sealed to the edge of the flange. When the tear strip is detached, the heat seal ruptures to release the closure. The closure can thereafter be applied to cover the container with the upper edge of the container sandwiched closely between the closure wall and flange.

14 Claims, 1 Drawing Sheet

TAMPER EVIDENT CONTAINER

FIELD OF THE INVENTION

This invention relates generally to containers and more particularly to a container that is constructed in a manner to visually indicate when it has been opened or tampered with.

BACKGROUND OF THE INVENTION

There have been a variety of tamper proof and tamper evident containers proposed for use in various applications. For example, in the case of foods, medicines and other consumer products, it is often desirable for the packaging to provide easily noted visual evidence when the package has been opened. The tamper evident packages that have been proposed in the past have generally been characterized by complexity that results in high costs and reliability problems. Further, many containers cannot be effectively closed again after they have been initially opened.

Containers with detachable tear strips have been proposed in various forms and typically provide a tear strip that must be removed in order to open the container. Thus, the presence of an intact tear strip indicates an unopened container and the absence or partial tearing of the strip indicates tampering. Although this type of construction has achieved some popularity, the techniques that have been used to construct the tear strips have resulted in high costs. Also, adequately closing and sealing the container once it has been opened has been a problem with this type of container construction.

SUMMARY OF THE INVENTION

In accordance with the present invention, a tamper evident container is equipped with a detachable tear strip that must be removed to open the container. The invention is characterized by a container body and a closure having a side wall that fits closely inside of the container body. The closure also includes a flange which is connected with the side wall, preferably by an annular neck. The tear strip is connected with the upper edge of the container body along a line of weakness that facilitates detachment of the tear strip when it is desired to open the container. The flange terminates in a lower edge that is heat sealed to the upper edge of the tear strip.

The container can be opened by tearing away the tear strip along the line of weakness which connects it with the container body. This also results in rupture of the heat seal so that the closure is released from the container body and can be removed to provide access to the contents of the container. The closure can be replaced on the container with the upper part of the container wall closely sandwiched between the flange on the outside and the closure wall on the inside. The neck on the closure seats on the upper edge of the container wall so that the closure has a tight fit on the container to effectively contain the contents.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
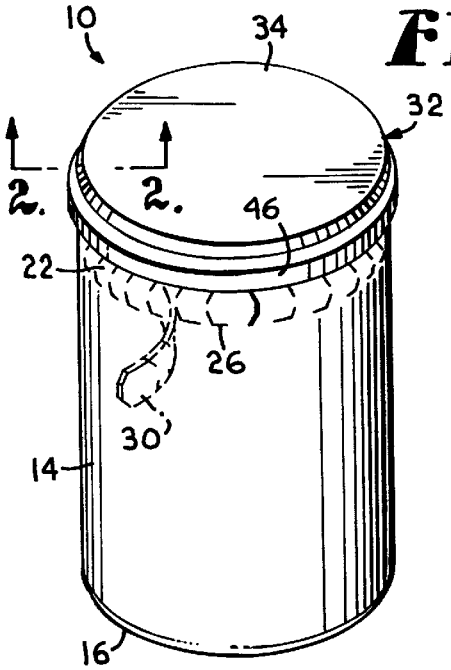
FIG. 1 is a perspective view of a tamper evident container constructed according to a preferred embodiment of the present invention, with the tear strip included on the upper portion of the container body shown partially detached from the container.
Figure 2:
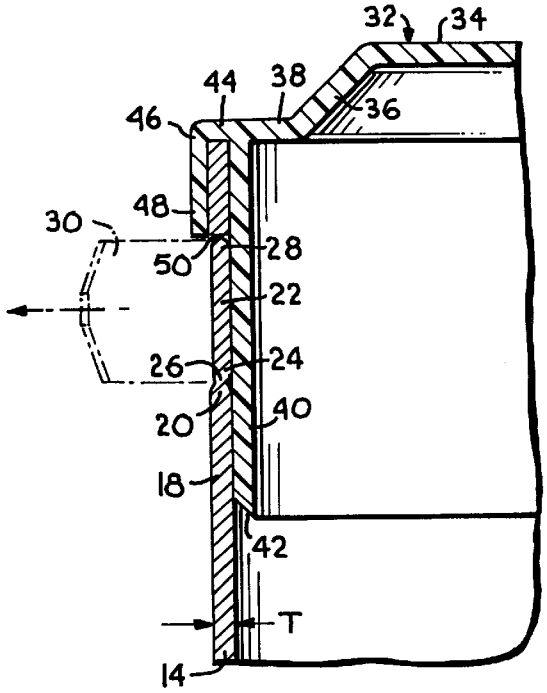
FIG. 2 is a fragmentary sectional view on an enlarged scale taken generally along line 2—2 of FIG. 1 in the direction of the arrows.
Figure 3:
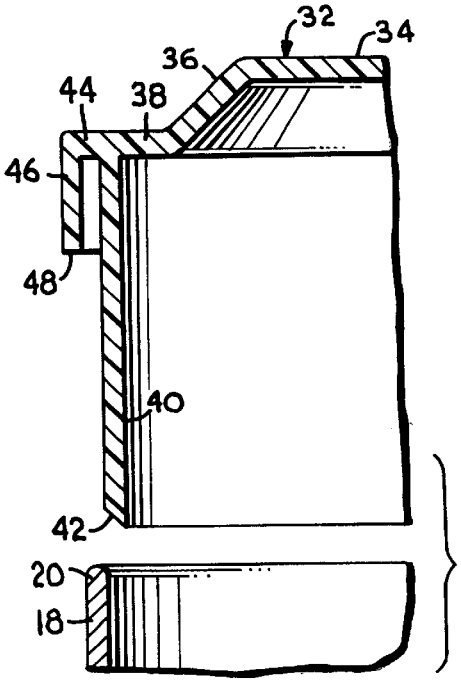
FIG. 3 is a fragmentary sectional view similar to FIG. 2, but showing the closure removed from the container after the tear strip has been detached.
Figure 4:
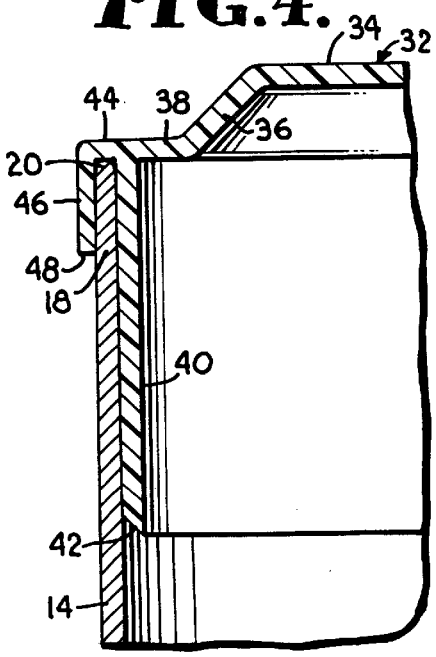
FIG. 4 is a fragmentary sectional view similar to FIGS. 2 and 3, but showing the closure replaced on the container after having been initially opened.

Referring now to the drawings in more detail and initially to FIG. 1, numeral 10 generally designates a container which may be used in a variety of applications, including holding various types of food items and particularly other, smaller containers which may contain foods and other materials. The container 10 includes a hollow container body 12 which holds the contents of the container. The container body has a cylindrical side wall 14 and a bottom 16 which may take the form of a disk closing the bottom of the side wall 14. As best shown in FIGS. 2–4, the side wall 14 of the container body has an upper end portion 18 which terminates in a circular upper edge 20. The container body 12 may be constructed of any suitable material such as paperboard coated with a thermoplastic material.

With reference to FIGS. 1 and 2 in particular, a detachable tear strip 22 has a lower edge 24 that is connected with the upper edge 20 of the container wall 14 along a circular line of weakness 26 which may be perforated or otherwise weakened. The tear strip 22 essentially forms an upward continuation of the side wall 14 extending above its upper end portion 18. The tear strip 22 also has an upper edge 28. The tear strip 22 is preferably provided with a tab 30 on one end which may be grasped with the fingers in order to detach the tear strip 22 from the container body 12.

A plug closure which is generally identified by numeral 32 is used to cover the otherwise open top of the container body 12. The closure 32 includes a discoidal lid portion 34 which is substantially flat. The closure 32 has a stepped construction and includes an inclined wall 36 which angles downwardly and outwardly from the outer periphery of the lid portion 34. An annular shoulder 38 extends outwardly from the lower edge of the inclined wall 36. The closure 32 has a cylindrical side wall 40 which extends downwardly from the shoulder 38 and has a size to fit closely inside of the container wall 14, as shown in FIG. 2. The lower edge of the side wall 40 is beveled at 42 to facilitate the fit of the side wall 40 inside of the container wall 14.

The plug closure 32 has a short annular neck 44 which extends outwardly from the upper edge of the side wall 40 and essentially forms an outer continuation of the shoulder 38. A downwardly extending flange 46 is connected at its upper end with the outer edge of the neck 44. The flange 46 is cylindrical and is spaced outwardly from and parallel to the side wall 40. The flange 46 is spaced away from wall 40 by the neck 44 a distance that is substantially equal to or slightly greater than the thickness dimension T (see FIG. 2) of the container wall 14.

The flange 46 terminates in a circular lower edge 48 which is adjacent to and connected with the upper edge 28 of the tear strip 22 by a heat scal 50. The closure 32 may be constructed of a suitable material such as paperboard coated with a thermoplastic which can be heated in order to provide the heat seal between the flange edge 48 and the tear strip edge 28.

In order to initially open the container 10, it is necessary to detach the tear strip 22 from the container body 12 by grasping the tab 30 and tearing the strip 22 away from the container body along the line of weakness 26. As the tear strip 22 is detached, the heat seal 50 is ruptured so that the flange 46 is released from its initial attachment to the tear strip. This releases the closure 34 and allows it to be lifted off of the top of the container body 12, thereby providing access to the contents of the container 10.

In order to replace the closure 32, it can simply be applied to the upper edge portion 18 of the container wall 14 by fitting the closure wall 40 inside of the container wall 14 with the flange 48 located adjacent to and outwardly of the container wall 14. The closure 32 can be lowered onto the upper edge portion 18 of the container until the underside of the neck 44 seats on the upper edge 20 of the container wall in abutting relationship with it, as shown in FIG. 4. The upper edge portion 18 of the container wall is closely sandwiched between the flange 46 on the outside and the closure wall 40 on the inside, with the seating of the neck 44 on edge 20 enhancing the tight fit of the closure 32 on the container body 12. When the closure 32 is replaced on the container body in this fashion after having been initially removed, it is located at a lower position than its initial position wherein the heat seal 50 holds the flange 46 at the position shown in FIG. 2 well above the edge 20 of the container side wall.

In this manner, the container 10 is constructed so that the presence of the tear strip 22 in an intact condition provides visual evidence that the container is unopened and has not been tampered with. At the same time, the closure 32 can be easily removed simply by tearing away the tear strip 22. Any remaining contents can be enclosed within the container body 12 by replacing the closure 32 and seating it in the position of FIG. 4 wherein it provides a tight fit on the top of the container to enclose the remaining contents of the container body.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. A tamper evident container assembly, comprising:

a container body having a container wall terminating in an upper edge portion presenting a selected thickness;

a tear strip on said upper edge portion of the container wall, said tear strip being detachable from said container wall;

a plug closure for closing the container body, said closure including a lid portion and a side wall which has a size to fit closely inside of the container wall;

a flange on said closure spaced outwardly from said side wall a distance substantially corresponding with the thickness of said container wall upper edge portion, said flange having a lower edge; and a seal sealing said lower edge of the flange to said tear strip to initially hold said plug closure on said container body in a first position covering said container body, said seal releasing when said tear strip is detached from said container wall to allow said closure to fit on said container body in a second position wherein said closure covers the container body with the upper edge portion of the container wall sandwiched between said flange and said side wall of the closure.

2. A container assembly as set forth in claim 1, wherein said seal comprises a heat seal.

3. A container assembly as set forth in claim 1, wherein:

said tear strip includes upper and lower edges;

said lower edge of said tear strip is connected with said upper edge portion of said container wall along a line of weakness to allow detachment of the tear strip from the container body; and said seal connects said lower edge of said flange with said upper edge of the tear strip.

4. A container assembly as set forth in claim 3, wherein said seal comprises a heat seal.

5. A container assembly as set forth in claim 4, including a neck on said closure connecting said flange with said side wall.

6. A container assembly as set forth in claim 3, including a neck on said closure connecting said flange with said side wall.

7. A container assembly as set forth in claim 6, wherein said neck abuts said upper edge portion of the container wall in the second position of said closure.

8. A container assembly as set forth in claim 1, including a neck on said closure connecting said flange with said side wall.

9. A container assembly as set forth in claim 8, wherein:

said upper edge portion of said container wall presents a substantially circular edge; and said neck abuts said circular edge in the second position of said closure.

10. A tamper evident container comprising:

a container body having a container wall presenting a selected thickness and terminating in an upper edge;

a tear strip connected to said upper edge of the container wall along a line of weakness, said tear strip being detachable from said upper edge along said line of weakness;

a plug closure for covering said container body, said closure having a lid portion and a side wall which has a size and shape to fit closely inside of said container wall;

a flange on said closure connected with said side wall by a neck and terminating in a lower edge, said neck being arranged to space said flange outwardly from said side wall by a distance substantially equal to the thickness of the side wall; and a heat seal acting to seal said lower edge of said flange to said tear strip to initially hold said closure in a first position covering the container body, said heat seal releasing when said tear strip is detached along said lien of weakness to allow removal of said closure from the container and placement of the closure on the container in a second position wherein the closure covers said container with said container wall sandwiched between said side wall and flange and said neck abutting said upper edge of the container wall.

11. A container as set forth in claim 10, wherein:

said tear strip has upper and lower edges;

said lower edge of said tear strip is connected with said upper edge of the container wall along said line of weakness; and said heat seal acts to seal said lower edge of said flange to said upper edge of said tear strip.

12. A tamper evident container construction comprising:

a container body having a generally cylindrical container wall terminating in an upper edge;

a tear strip having top and bottom edges, said bottom edge being connected with said upper edge of the container wall at a line of weakness along which the tear strip can be torn away from the container body;

a plug closure having a lid portion and a generally cylindrical side wall arranged to fit closely inside of said container wall;

a flange on said closure spaced a selected distance outwardly from said side wall and terminating in a lower edge; and a heat seal providing a seal between said lower edge of the flange and said upper edge of the tear strip to initially hold the closure in a raised position covering the container body, said heat seal releasing when the tear strip is torn away from the container body along said line of weakness to allow removal of said closure from the container body and placement of said closure on the container body in a lower position wherein the closure covers the container body with said container wall sandwiched closely between said side wall and said flange.

13. A container construction as set forth in claim 12, including a neck on said closure connecting said flange with said side wall.

14. A container construction as set forth in claim 13, wherein said neck seats on said upper edge of the container wall in said lower position of said closure.

* * * * *